US005735222A

United States Patent [19]

Webb

[11] Patent Number: 5,735,222

[45] Date of Patent: Apr. 7, 1998

[54] VERTICALLY ADJUSTABLE DETACHABLE KEYBOARD TRAY

[76] Inventor: Sharon L. Webb, 9680 Paseo Montril, San Diego, Calif. 92129

[21] Appl. No.: 605,283

[22] Filed: Feb. 9, 1996

Related U.S. Application Data

[63] Continuation of Ser. No. 198,369, Feb. 18, 1994, abandoned.

[51] Int. Cl.[6] ..... A47B 9/06; A47B 9/14

[52] U.S. Cl. ..... 108/144; 108/5; 108/90; 108/98; 108/152; 108/110; 108/106; 108/50; 248/455; 248/91; 312/194; 312/208.1; 312/223.3

[58] Field of Search ..... 108/144, 90, 98, 108/106, 110, 50, 150, 5; 312/194, 208.1, 208.2, 223.3; 248/455, 918, 922, 465, 447.2

[56] References Cited

U.S. PATENT DOCUMENTS

| | | | |
|---|---|---|---|
| 1,824,882 | 9/1931 | Kradolfer | 312/208.1 |
| 2,580,144 | 12/1951 | Webster | 108/50 |
| 2,831,746 | 4/1958 | Hartnett | 312/208.1 |
| 3,842,758 | 10/1974 | Armstrong et al. | 108/98 |
| 3,938,766 | 2/1976 | Herbolsheimer et al. | 312/208.1 |
| 4,379,429 | 4/1983 | Grubbe et al. | 108/5 X |
| 4,381,714 | 5/1983 | Henneberg et al. | 108/147 |
| 4,384,532 | 5/1983 | Staff | 108/90 |
| 4,493,267 | 1/1985 | Jedziniak | 108/50 |
| 4,516,509 | 5/1985 | Langenegger et al. | 108/147 |
| 4,625,657 | 12/1986 | Little et al. | 108/5 X |
| 4,691,888 | 9/1987 | Cotterill | 248/918 X |
| 4,706,919 | 11/1987 | Soberalski et al. | 248/918 X |
| 4,717,112 | 1/1988 | Pirkle | 248/918 X |
| 4,747,353 | 5/1988 | Watt | 108/144 |
| 4,779,540 | 10/1988 | Dion et al. | 108/98 |
| 4,893,775 | 1/1990 | Long | 248/918 X |
| 5,072,905 | 12/1991 | Hyatt | 248/918 X |
| 5,101,736 | 4/1992 | Bommarito et al. | 108/147 |
| 5,104,086 | 4/1992 | Ramey, III et al. | 248/918 X |
| 5,119,742 | 6/1992 | Simmie | 108/152 |
| 5,143,344 | 9/1992 | Johnson et al. | 108/106 |
| 5,174,223 | 12/1992 | Nagy et al. | 108/144 |
| 5,181,681 | 1/1993 | Edwards | 108/106 |
| 5,287,815 | 2/1994 | Gross | 108/50 |
| 5,320,313 | 6/1994 | Crowe | 248/918 X |
| 5,351,897 | 10/1994 | Martin | 248/918 X |
| 5,365,860 | 11/1994 | Billington, III | 208/110 X |
| 5,377,951 | 1/1995 | Johnson et al. | 248/918 X |
| 5,379,973 | 1/1995 | Rader | 248/918 X |
| 5,402,972 | 4/1995 | Schmidt | 248/918 X |
| 5,405,109 | 4/1995 | Nordnes | 248/918 X |
| 5,481,987 | 1/1996 | Maitland | 108/90 |
| 5,484,124 | 1/1996 | Billings | 248/918 X |
| 5,590,607 | 1/1997 | Howard | 108/98 |

*Primary Examiner*—Peter M. Cuomo
*Assistant Examiner*—Rodney B. White
*Attorney, Agent, or Firm*—Thomas J. Tighe

[57] ABSTRACT

Vertical suspension legs are clamped to a margin of a desk top. The suspension legs support a tray at a plurality of selectable vertical levels. There is a connection station on each vertical leg corresponding to each of the vertical levels. The tray has engagement devices for engaging the connection stations corresponding to any selected vertical level. Each connection station can be a plurality of detents which mate with a corresponding plurality of tangs projecting from a side of the tray. The plurality of tangs engaging a corresponding plurality of detents prevents rotation of the tray about the connection points. The stations can also be laterally open horizontal open slots defined by the vertical legs which mate with side rails projecting from the tray. Slidingly extending through the vertical legs are vertical shanks, the top ends of which are connected to an elongated crossbar. The desk top is clamped between the crossbar and the tops of the vertical legs by means of tightening screws which urge the vertical legs toward the crossbar. The crossbar can define a slot into which a document holder can be inserted.

20 Claims, 4 Drawing Sheets

VERTICALLY ADJUSTABLE DETACHABLE KEYBOARD TRAY

This is a CONTINUATION of application Ser. No. 08/198,369, filed Feb. 18, 1994 now abandoned.

BACKGROUND OP THE INVENTION

This invention relates in general to vertically adjustable keyboard trays, and in particular to such that are releasably attachable to desk tops, tables and the like.

This invention can be used to great advantage in situations where a person must use a computer keyboard but the only surface upon which the keyboard can rest is uncomfortably too high. Such situations are not uncommon because conventional desks are not equipped with means for vertically adjusting keyboard level. Prior art discloses keyboard drawers which can be attached to the underside of the desk top in permanent attachment, as by screws, but the keyboard is still not vertically adjustable beyond the two levels, the desk top level or the underside drawer level. Also, many people are reluctant to mar office furniture by attaching such underside drawers.

This invention also has the advantage that the keyboard does not occupy desk top space and the keyboard cable does not need to be on the desk top.

This invention provides a means for temporarily attaching a keyboard tray to an edge of a desk and further provides means for vertically adjusting the tray over multiple levels. In addition, it provides a means for holding documents in a more readable upright or semi-upright attitude.

Other advantages and attributes of this invention will be readily discernable upon a reading of the text hereinafter.

SUMMARY OF THE INVENTION

An object of this invention is to provide an apparatus for releasably attaching a vertically adjustable tray to an edge of a desk, table or the like for holding a keyboard.

A further object of this invention is to provide an apparatus as described in the preceding paragraph which provides a stable, vertically adjustable platform for a keyboard.

A further object of this invention is to provide an apparatus as described in the preceding paragraphs which also provides a means for holding work documents in a more readable upright or semi-upright attitude.

These, and other objects implied or expressed in the text herein, are accomplished by a device for suspending a keyboard from a desktop comprising a tray for holding a keyboard, means for vertically suspending the tray at any selected one of a plurality of vertical levels, and means for clamping the device onto a margin of a desktop. The device also can include a document holder. Preferably the means for vertically suspending the tray includes a plurality of vertical members, each having a connection station corresponding to each of the selectable vertical levels, and means affixed to the tray for connecting it to the stations corresponding to any selected vertical level. The connection stations can be detents defined by the vertical members which catch tangs protruding from the sides of the tray. Each station can also be a horizontal slot defined by its corresponding vertical member, and the means for connecting the tray to these slots can be rails along the sides of the tray which fit into the slots. The device is preferably clamped to the margin of a desktop by an elongated bar atop the desk top and the tops of the vertical members which slide along vertical shanks and which can be forced against the bottom of the desk top by tightening screws.

DESCRIPTION OF THE PREFERRED EMBODIMENT

Figures 1, 2, 3, 16:
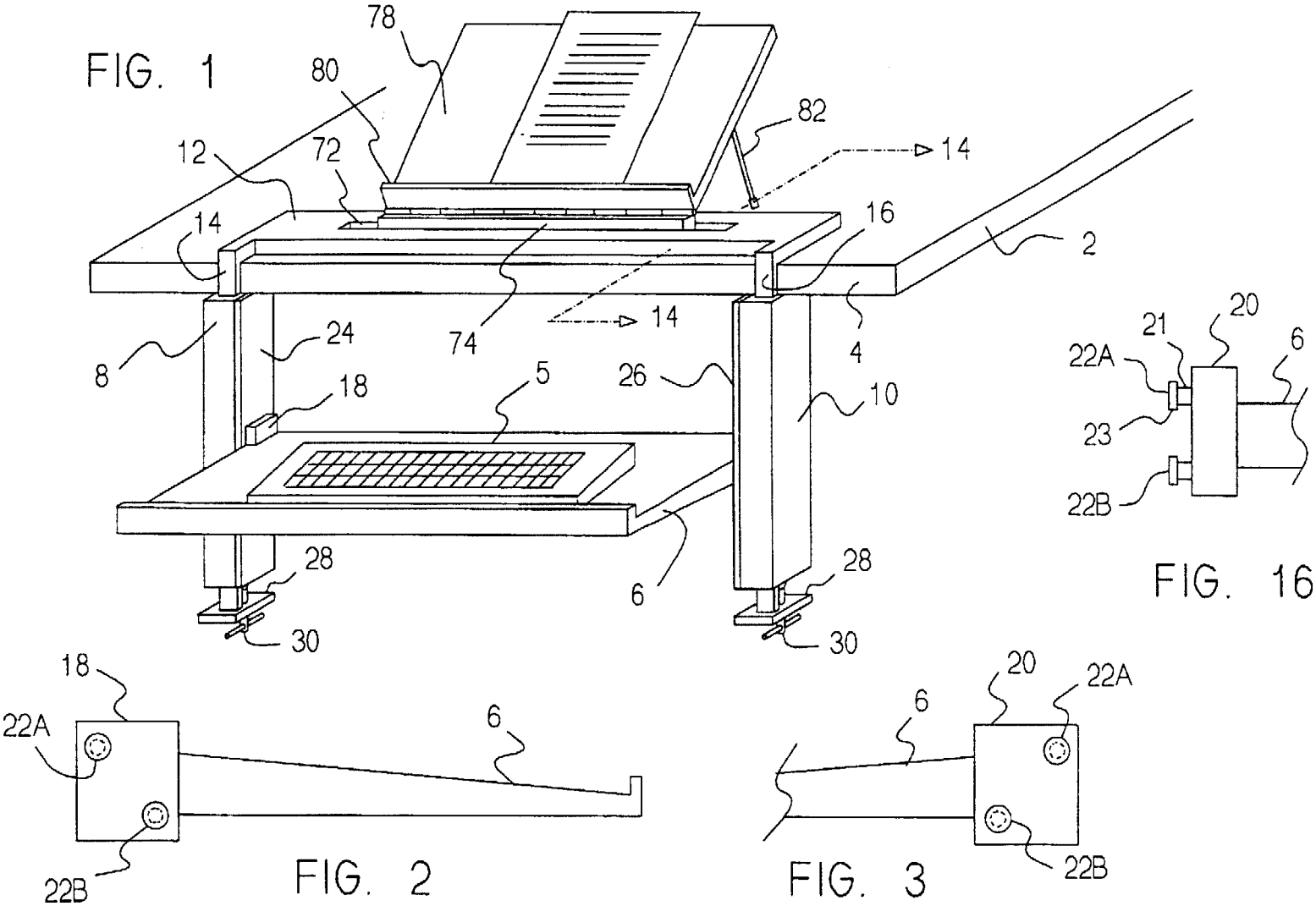
FIG. 1 is a pictorial drawing of a first embodiment of this invention supporting a keyboard and attached to a surface such as a desk top.
FIG. 2 is an elevational view of the left side of the keyboard tray illustrated in FIG. 1, "left" being referenced to a viewer.
FIG. 3 is a partial elevational view of the right side of the keyboard tray illustrated in FIG. 1.
FIG. 16 is a partial rear elevational view of the keyboard tray illustrated in FIG. 1.

Referring to FIG. 1, a first embodiment of this invention is illustrated. A work surface 2 such as a desk top has this invention clamped to a forward margin 4. (As used herein and in the claims which follow "desk top" shall refer to and mean a desk top, a table top, or any structure having a margin to which the invention as described herein can be clamped.) A keyboard 5, such as a computer keyboard, is resting on a tray 6 that is suspended below the desk top and in front of the desk top's forward margin by a pair of vertical suspension legs, 8 and 10. The desk top's forward margin is clamped between the tops of the legs and an elongated clamp plate 12, or bar, lying flat against the upper surface of the desk top. At its opposite long ends the clamp plate is connected to a pair of vertical shanks, 14 and 16, that slidingly extend through longitudinal bores (not designated) defined by the suspension legs, 8 and 10 respectively. As will be further explained, the clamp plate acts as an elongated upper jaw of a clamp and the tops of the legs act as lower jaws opposing the plate in clamping the margin of the desk top, and the keyboard tray is vertically adjustable along the suspension legs.

Referring to FIGS. 2, 3 and 16, the keyboard tray 6 of the first embodiment is illustrated to have a pair of mounting blocks, 18 and 20, oppositely affixed to the tray's sides, such as at the sides' back corners. As illustrated the mounting blocks are flush with their respective tray sides. Projecting from an outboard face of each mounting block are a pair of tangs in the form of pins, 22A and 22B, each pin having a neck 21 and a wider head 23. The pins of each mounting block are vertically and horizontally offset one from the other.

Figure 5:
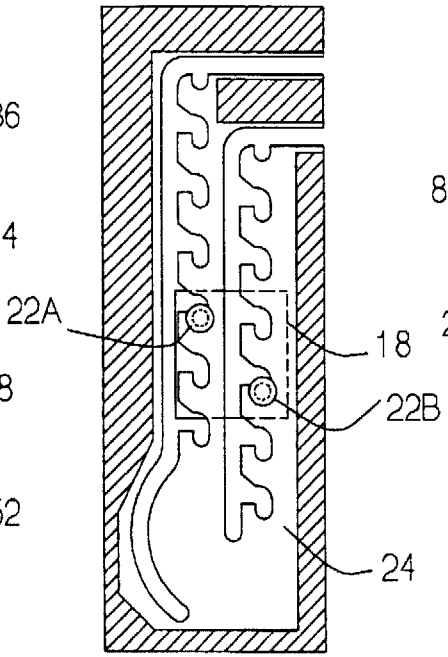
FIG. 5 is a cross-sectional view taken along line 5—5 of FIG. 6.
Figure 4:
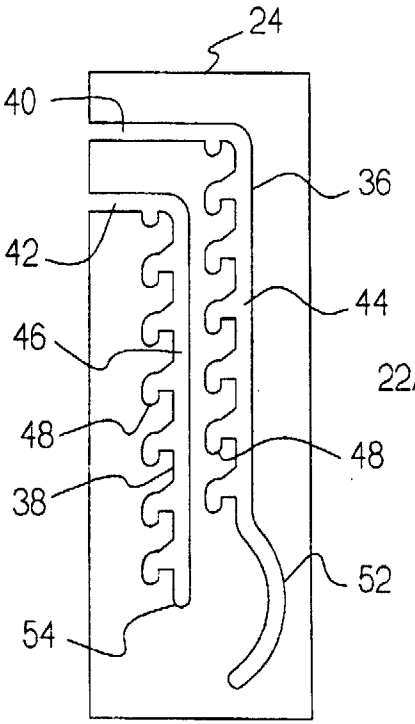
FIG. 4 is a front elevational view of a channel plate affixed to a lateral inboard side of a left vertical leg of the invention illustrated in FIG. 1.

Referring to FIGS. 1–6 and 16, the vertical suspension legs, 8 and 10, have channel plates, 24 and 26 respectively, affixed to their inboard sides. FIG. 4 illustrates the outside face of a channel plate 24 affixed to the left suspension leg 8 of FIG. 1. FIG. 5 illustrates the inside face of the same channel plate and how a mounting block 18 engages the channel plate by means of the block's pins, 22A and 22B, to hold the tray 6 in place. In general each mounting block can engage its respective suspension leg at a plurality of vertical levels.

Figure 7:
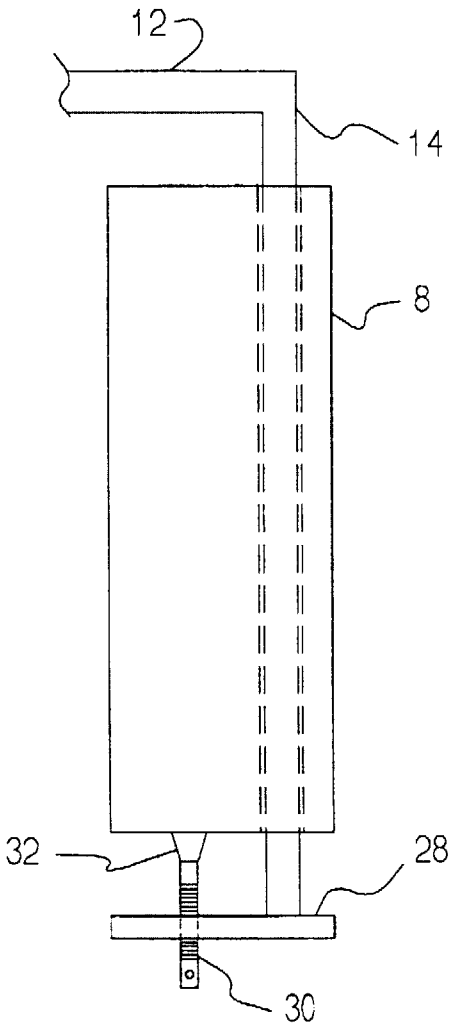
FIG. 7 is an elevational view of a lateral outboard side of the left leg of the invention illustrated in FIG. 1.
Figure 6:
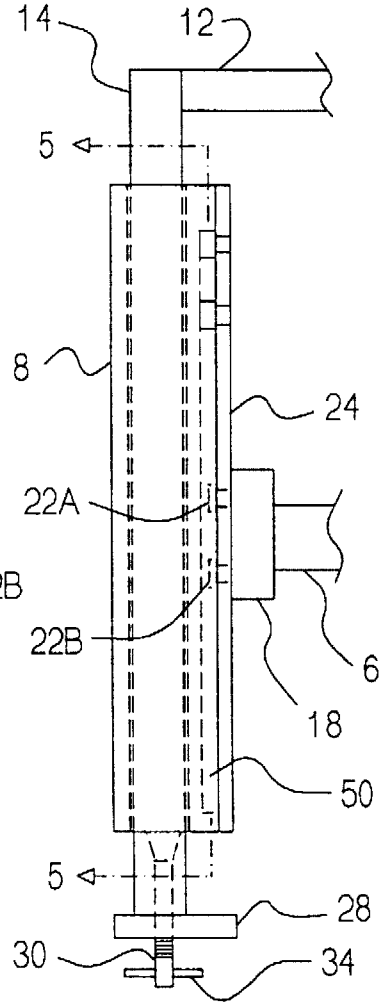
FIG. 6 is a front elevational view of the left vertical leg of the invention illustrated in FIG. 1.

Referring to FIGS. 1, 6 and 7, it can be seen that the shank 14 projects out the bottom of the suspension leg 8 through which it extends, and is connected to a base plate 28 generally parallel to the bottom face of the leg. Engaged in a threaded through bore (not designated) defined by the base plate and extending normally through the plate is a threaded bolt 30. An inverted cone shaped head 32 of the bolt faces upward and in operation acts against the bottom face of the leg. At the opposite end of the bolt is a grip bar 34 by which the bolt can be screwed toward or away from the suspension leg by hand. As the bolt is screwed toward the leg, the bolt head presses against the bottom face of the leg and tends to move the leg along the shank toward the clamp plate 12, closing the gap between the top of the leg and the clamp plate. In this way a desk top margin can be clamped between the tops of the legs and the clamp plate. The areas of the top faces of the suspension legs are suitable, in relation to the size of the clamp plate 12 to keep the tray stable during normal operation of a keyboard resting upon the keyboard tray.

Referring again to FIGS. 4–6, each channel plate has two through channel networks, 36 and 38, one network for engaging each of a mounting block's pins, 22A and 22B respectively. The generally uniform width of each channel network is larger than the diameter of the necks 21 of the pins but smaller than the diameter of the heads 23 of the pins. Each network has an entry section, 40 and 42 respectively, which opens to a front edge of its channel plate for entry and removal of a mounting block pin. Following the entry section is a main section, 44 and 46 respectively, each having a plurality of branch slots that each terminate in a vertical seat, or detent, 48 for a pin. The spacing of adjacent networks and the relative disposition of their respective pin seats are such that each pin seat of one network has a corresponding pin seat in the adjacent network. Corresponding pin seats are vertically and horizontally offset one from the other to match the offset of the mounting block pins, and constitute a connection station.

Referring again to FIGS. 4–6, the inboard side of each suspension leg (the side to which the channel plate is affixed) defines a recess 50. The recess preferably has a uniform depth great enough to easily accommodate the thickness of the mounting block pin heads, and a shape that allows unimpeded travel of the pins throughout their respective channel networks. FIG. 5 best illustrates the shape of the recess, and further illustrates the pins of a mounting block 18 disposed in corresponding pin seats of channel plate 24.

Figure 13:
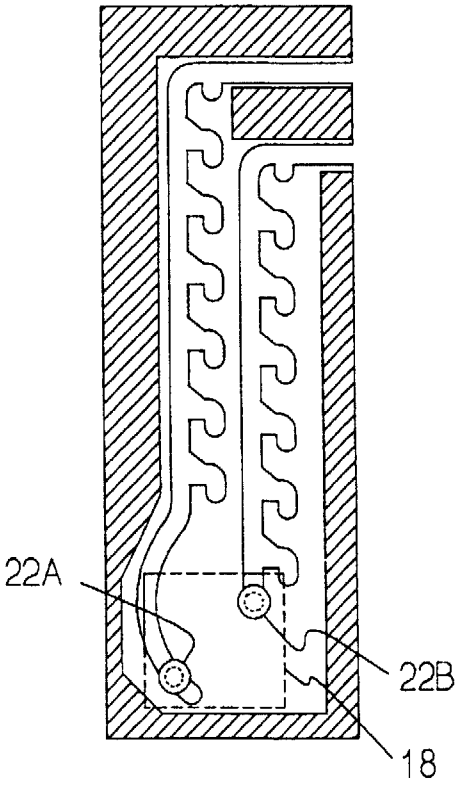
FIG. 13 is a view identical to FIG. 5 showing how the keyboard tray can be rotated upward to a vertical orientation when not in use.

Referring again to FIGS. 4, 5 and 13, the channel networks, 36 and 38, of each channel plate include end sections that are designed to allow the keyboard tray to be rotated generally 90° up and toward the desk top in order to be set in a vertical position as when not in use. As illustrated, the channel network 38 in which a lower mounting block pin 22B travels has an end section consisting of a pin seat 54 at the low end of the network. As illustrated, the channel network 36 in which an upper mounting block pin 22A travels has an end section consisting of an arcuate run 52 at the low end of the network. In operation, when the lower pin 22B is moved to the end pin seat 54, the upper pin 22A can still travel downward along the arcuate run which is concentric with the end pin seat 54 and which has a median radius equal to the distance between pins' centers. This allows the mounting block, and therefore the tray 6, to be rotated through the same degrees as is defined by the arcuate run—slightly more than 90°. FIG. 13 best illustrates a mounting block 18 that has been rotated 90° counterclockwise from it orientation shown in FIG. 5. Since the tray is affixed to the mounting block, it too rotated 90° up and toward the desk top.

Figure 12:
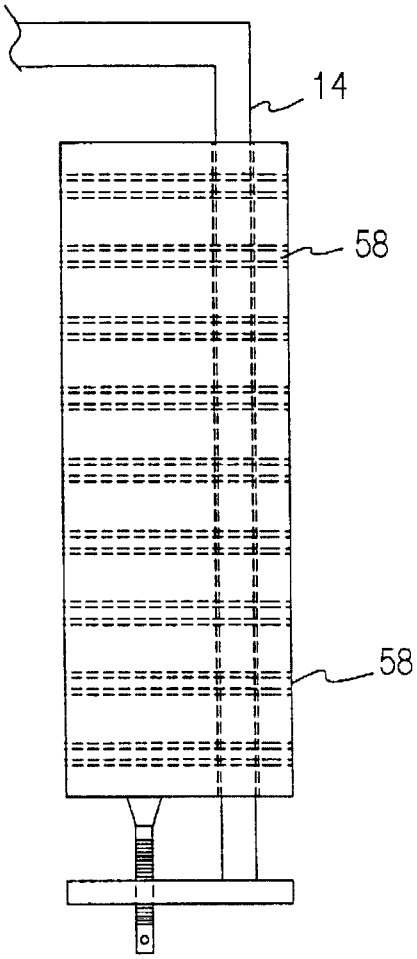
FIG. 12 is a side elevational view of a lateral outboard side of the left leg according the second embodiment of this invention.
Figure 11:
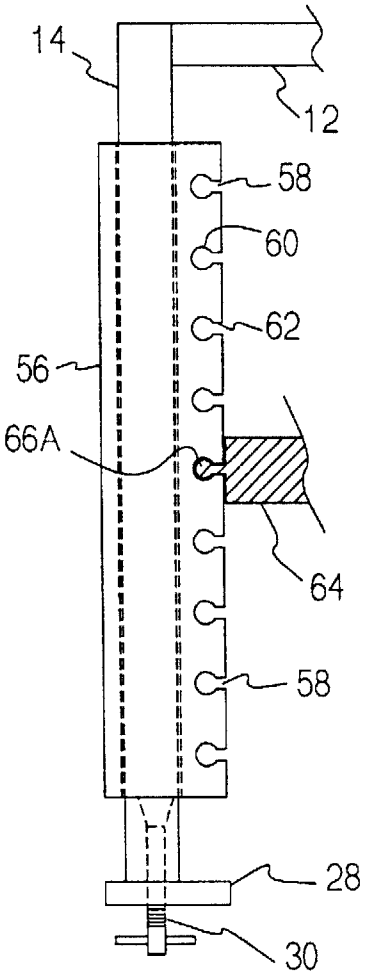
FIG. 11 is a front elevational view of a left vertical leg according to the second embodiment of this invention.
Figure 8:
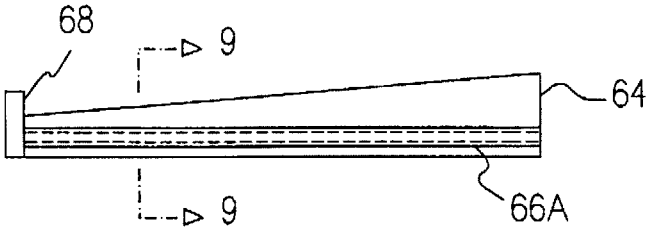
FIG. 8 is a left side elevational view of a keyboard tray according to a second embodiment of this invention.
Figure 9:
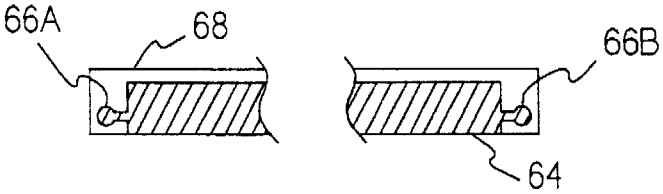
FIG. 9 is a cross-sectional view taken along line 9—9 of FIG. 8.
Figure 10:
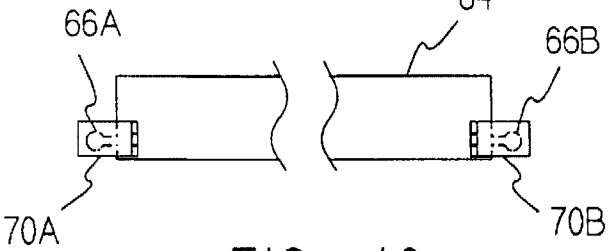
FIG. 10 is a rear elevational view of the keyboard according to the second embodiment of this invention.

Referring to FIGS. 8–12, a second embodiment has suspension legs different from the first embodiment, a left leg 56 as illustrated in FIGS. 11 and 12 being an example. Rather than having channel plates affixed to them, the inboard sides of the suspension legs each define a plurality of horizontal, parallel and open slots 58 that are uniform and vertically spaced apart. The cross-sectional profile of each slot has a circular base 60 and a narrower neck 62 to the opening. The lateral edges of the keyboard tray 64 have uniform, elongated, horizontal rails, 66A and 66B, protruding therefrom, the rails each having a cross-sectional profile identical to the suspension leg slots but slightly smaller in size to allow the rails to slide in the slots. Each slot of one suspension leg has a corresponding slot defined by the opposite leg, corresponding slots generally being at the same vertical position to hold the tray level. To prevent the keyboard tray from sliding too far in, the keyboard tray has a vertical wall 68 along its forward edge, the lateral ends of which extend beyond the tray's side rails. The lateral extensions of this wall catch the fronts of the suspension legs and prevent further inward movement of the tray. To prevent a user from inadvertently pulling the keyboard tray completely out of the slots, the backside of the keyboard tray has at opposite corners a pair of hinged stop plates, 70A and 70B. When the tray is being inserted into a pair of slots, the stop plates are rotated inwardly on their hinges to a position where they are not an obstruction. However, once the tray is inserted, the stop plates can be rotated outwardly and latched in a position, such as illustrated, to catch the backs of the suspension legs and prevent further movement of the tray forward.

Figure 15:
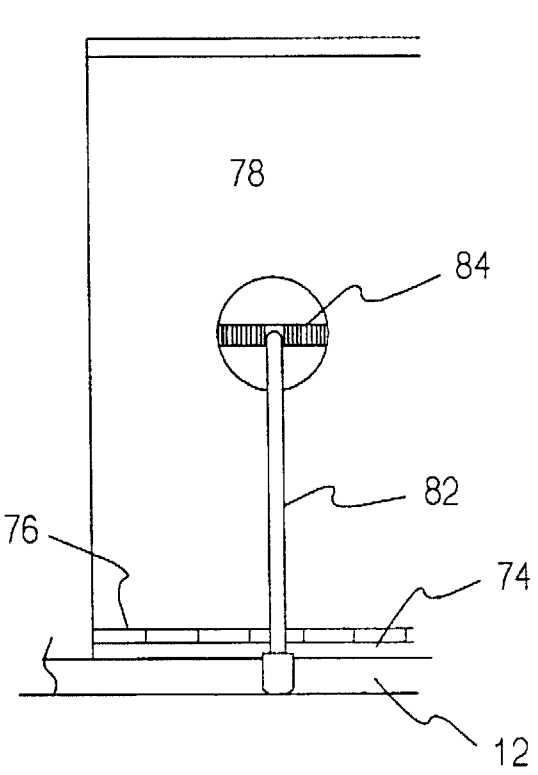
FIG. 15 is a partial rear elevational view of the back of the document holder.
Figure 14:
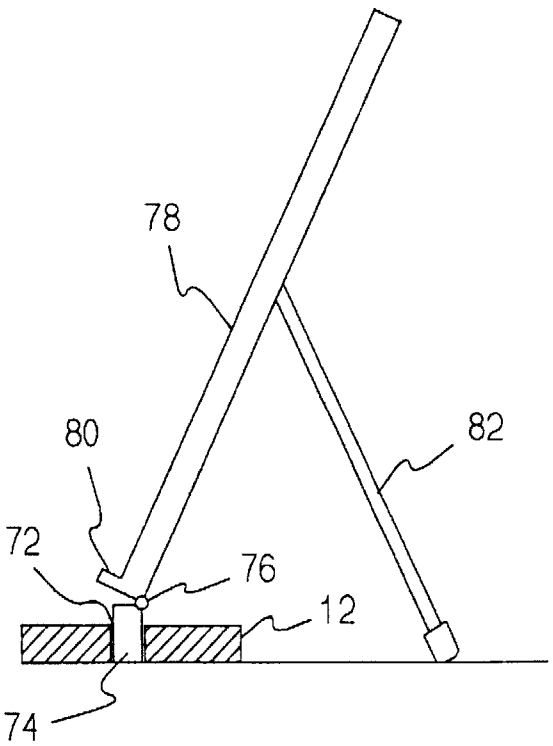
FIG. 14 is a cross-sectional view taken along line 14—14 in FIG. 1 showing the document holder edgewise.

Referring to FIGS. 1, 14 and 15, an optional feature of both embodiments is illustrated. According to this option, the clamp plate 12 can define an elongated slot 72. The slot is oriented to be generally parallel to the length of the keyboard tray. Insertable into the elongated slot is a uniform bar 74. Pivotly affixed to an upper, long corner of the bar by hinge 76 is a plate 78. Preferably the plate is rectangular and at the base of the plate is a forward lip 80. Connected to the back of the plate is one or more strut legs 82. The strut legs at their upper ends are hinged to the back of the plate 78 by means of spring biased hinges 84. The plate 78 is large enough to provide support backing for documents and sheets of paper. In operation, the bar 74 is inserted into slot 72 and held in place by a close fit between the slot and the bar. The document plate is then tilted back to a suitable extent and the strut leg is rotated away from the plate and to an extent necessary to support the plate. Preferably the spring biased hinge 84 tends to keep the strut leg 82 close against the back of the plate.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A device for suspending a keyboard from a desk top comprising:

(a) tray means for supporting a keyboard, (b) means for vertically suspending the tray means below the desk top at any selected one of a plurality of vertical levels, (c) means, affixed to the means for vertically suspending the tray means, for clamping onto a margin of the desk top, and (d) wherein the tray means provides a level surface for supporting the keyboard at each selected vertical level.

2. The device according to claim 1 further comprising means, connected to the means for clamping, for holding documents.

3. A device for suspending a keyboard from a desk top comprising:

(a) tray means for supporting a keyboard;

(b) means for vertically suspending the tray means below the desk top at a selected one of a plurality of vertical levels, said means comprising:

(1) a plurality of vertical members, (2) a connection station on each vertical member corresponding to each of said vertical levels, and (3) means for engaging the tray means to the connection station corresponding to the selected one of the plurality of vertical levels;

(c) means, affixed to the means for vertically suspending the tray means, for clamping onto a margin of the desk top; and (d) wherein the tray means provides a level surface for supporting the keyboard at each selected vertical level.

4. The device according to claim 3 wherein the means for engaging the tray means to the connection stations comprise tang means, projecting from the tray means, for being caught, and wherein each connection station comprises detent means for catching corresponding tang means.

5. The device according to claim 4 wherein each tang means comprises a plurality of pins, and further comprising:

(a) a plurality of channels defined by each vertical member in which corresponding pins travel, there being a separate channel for each pin, and (b) a plurality of vertical pin seats branching from each channel, the pins seats being the detent means.

6. The device according to claim 5 further comprising means for laterally confining said each pin to within its channel.

7. The device according to claim 6 wherein the means for laterally confining each pin in its channel comprises a pin head means, larger than the channel, for preventing said each pin from laterally passing through its respective channel.

8. The device according to claim 3 wherein there are two vertical members disposed on opposite sides of the tray; wherein the means for engaging the tray means to the connection stations comprise side rails projecting from the tray; and wherein each connection station comprises a laterally open slot defined by a vertical member which mates with a tray side rail.

9. The device according to claim 8 further comprising means for laterally confining each rail to within a slot in which the rail is disposed.

10. The device according to claim 9 wherein the means for laterally confining each rail comprises an enlarged margin on each rail, and a correspondingly enlarged portion in each slot.

11. The device according to claim 3 wherein the means for clamping comprises:

(a) an upper jaw means for abutting a top of the desk top, (b) a plurality of vertically adjustable lower jaw means for abutting a bottom of the desk top, and (c) means for urging the upper and lower jaw means together.

12. The device according to claim 11 wherein the upper jaw means comprises a cross member; the lower jaw means comprise tops of the vertical members; and the means for urging comprises:

(a) a vertical bore defined by each vertical member, (b) a shank slidingly extending through each bore, (c) a top of each shank being affixed to the cross member, and (d) means, at the base of each shank, for urging respective vertical members toward the cross member.

13. A device for suspending a keyboard from a desk top comprising:

(a) tray means for holding a keyboard, (b) an upper jaw means for abutting a top of the desk top, (c) a plurality of vertical members for vertically suspending the tray means at any selected one of a plurality of vertical levels, the vertical members each including a lower jaw means for abutting a bottom of the desk top, and (d) means affixed to the upper jaw means for urging the lower jaw means of the vertical members toward the upper jaw means.

14. The device according to claim 13 wherein the means for urging comprises:

(a) a vertical through-hole defined by each vertical member, (b) for each through-hole a shank extending therethrough, each shank being rigidly connected to the upper jaw means, each vertical member being slidable along its respective shank, and (c) means for urging the vertical members along respective shanks toward the upper jaw means.

15. The device according to claim 14 wherein the upper jaw means comprises a cross member, and further comprising an angularly adjustable rigid backing means for holding documents at an angle from horizontal, and means for connecting the backing means to the cross member.

16. The device according to claim 15 wherein the means for connecting the backing means to the cross member comprises an elongated cross slot defined by the cross member and a mating insert affixed to a base of the backing means.

17. The device according to claim 13 wherein the tray means provides a level surface for supporting the keyboard at each selected vertical level.

18. A device for suspending a keyboard from a desk top comprising:

(a) tray means for holding a keyboard, (b) jaw means for abutting a top of the desk top.

(c) means for vertically suspending the tray means at any selected one of a plurality of vertical levels, said means for vertically suspending being slidably connected to said jaw means in a manner to clamp a margin of the desk top therebetween, and (d) means for urging together the jaw means and the means for vertically suspending.

19. A device for suspending a keyboard from a desk top comprising:

(a) tray for supporting a keyboard;

(b) means for vertically suspending the tray means below the desk top at a selected one of a plurality of vertical levels;

(c) means, affixed to the means for vertically suspending the tray means, for clamping onto a margin of the desk top;

(d) wherein the tray means provides a level surface for supporting the keyboard at each selected vertical level; and (e) means, at a vertical level, for rotating the tray into a vertical orientation.

20. A device for suspending a keyboard from a desk top comprising:

(a) tray means for supporting a keyboard;

(b) means for vertically suspending the tray means below the desk top at any selected one of a plurality of vertical levels;

(c) means, affixed to the means for vertically suspending the tray means, for clamping onto a margin of the desk top, said means for clamping comprising:

(1) an upper jaw means for abutting a top of the desk top, (2) a plurality of vertically adjustable lower jaw means for abutting a bottom of the desk top, and (3) means for urging the upper and lower jaw means together; and (d) wherein the tray means provides a level surface for supporting the keyboard at each selected vertical level.

* * * * *

UNITED STATES PATENT AND TRADEMARK OFFICE

CERTIFICATE OF CORRECTION

PATENT NO. : 5,735,222
DATED : Apr. 7, 1998
INVENTOR(S) : Sharon L. Webb

It is certified that error appears in the above-identified patent and that said Letters Patent is hereby corrected as shown below:

Column 7, claim 19, line 11, insert --means-- immediately after the word "tray"

Signed and Sealed this

Twenty-third Day of June, 1998

Bruce Lehman

*Attest:*

BRUCE LEHMAN

*Attesting Officer*

*Commissioner of Patents and Trademarks*